US005532044A

United States Patent [19]

Jen

[11] Patent Number: 5,532,044

[45] Date of Patent: Jul. 2, 1996

[54] FOLDABLE PULP MOLDED CUSHIONING MATERIAL

[76] Inventor: Hsieh C. Jen, No. 22-26, Lin 1, Hsia-Tien Village, Hsin Wu Shian, Taoyuan Shien, Taiwan

[21] Appl. No.: 350,298

[22] Filed: Dec. 6, 1994

[51] Int. Cl.[6] ..... B32B 3/28

[52] U.S. Cl. ..... 428/167; 428/174; 428/542.8; 493/967; 493/904; 206/193; 206/564; 206/586; 206/587; 206/524.9; 220/6; 220/62

[58] Field of Search ..... 428/174, 532, 428/167, 34.1, 192, 212, 542.8; 493/904, 967; 206/193, 491, 499, 564, 586, 587; 220/6, 62

[56] References Cited

U.S. PATENT DOCUMENTS 1,701,238 2/1929 Kennedy ..... 162/230

*Primary Examiner*—Donald J. Loney
*Attorney, Agent, or Firm*—W. Wayne Liauh

[57] ABSTRACT

Disclosed is a flat type pulp-molded cushioning material on which a number of raised portions are provided to serve as shock absorbers and a plurality of notches are provided at predetermined positions to allow said flat cushioning material to be folded along said notches to form a box-like means with a desired configuration corresponding to the shape of an article to be packed therein. The erected portions of the flat material can be suitably limited in place by the side walls of an outer packing container, which together with the fitly contact of the cushioning material with the packed article provide enhanced effect of cushioning. Moreover, the flat cushioning material can be molded more easily and can be more conveniently stored and transported at lower cost.

2 Claims, 4 Drawing Sheets

FOLDABLE PULP MOLDED CUSHIONING MATERIAL

BACKGROUND OF THE INVENTION

To protect products from being damaged by collisions during transportation, manufacturers would usually put cushioning material in the packing container to surround and thereby protect the products in the container for shipping. In the past, molded polylon was used as cushioning material in packing. However, since polylon can not be recycled and forms an environmental hazardous pollutant, its use as packing or cushioning material has been strictly prohibited by many advanced and developed countries. These countries also clearly regulate that such cushioning material must be made from recycled, environmental hazard-free pulp.

FIG. 1 shows a conventional pulp-molded cushioning material 10 which is in the form of a box with side walls 11. For the mold to be easily shaken out, the side walls 11 of the box-like cushioning material 10 must be so formed that they are slightly inclined. These slightly inclined side walls 11 also permit the box-like cushioning material 10 to be conveniently stacked. However, following disadvantages are found in the above described box-like cushioning material:

1. The box-like cushioning material 10 each has a considerable height and will therefore, occupy large room after being stacked one after another and cause inconvenience in the storage and transportation thereof.
2. The inclined side walls 11 prevent the cushioning material 10 from fitly contacting with and accordingly, protecting the product 41 packed therein. That is, the cushioning effect provided by the box-like cushioning material 10 is largely reduced.
3. Raised portions 13 formed on the side walls 11 must be a continued portion of the bottom side 12 of the box 10 to facilitate the shaking out of mold. This will obviously restrict the positions and dimensions of the raised portions 13 and therefore reversely affects the cushioning function thereof.
4. To prevent the three-dimensional box 10 from deformation, flange 14 must be provided on the box 10 around its top periphery to enhance the strength of the box 10. The flange 14 will cause a considerable clearance between the packing container and the product being packed and therefore, reduces the cushioning function of the box-like cushioning material 10.
5. The mold for making the pulp molding is made of aluminium and must be precisely engraved and drilled by means of computer (the whole mold is properly provided with multiple through holes to facilitate the attachment of pulp to the mold by the application of the vacuum. Due to the high side walls of the box-like cushioning material 10, the mold for it would be thicker, too.

SUMMARY OF THE INVENTION

It is therefore a primary object of the present invention to provide a foldable pulp-molded cushioning material which can be easily formed from pulp molding.

Another object of the present invention is to provide a foldable pulp-molded cushioning material which can be conveniently stored and transported without occupying large room.

A further object of the present invention is to provide a foldable pulp-molded cushioning material which can fitly contact with the product packed therein to provide the latter with better cushioning effect.

The foldable pulp-molded cushioning material, according to the present invention, is mainly an unfolded flat body consisting of a bottom and flaps extending from the edges of the bottom. Notches are provided between the bottom and the flaps at joints thereof so that the flaps may be erected relative to the bottom along the notches to form a three-dimensional box-like cushioning material. The erected flaps are then restricted in place by the walls of an outer packing container to fitly contact with the product packed therein to provide the latter with enhanced cushioning effect.

DETAILED DESCRIPTION OF THE PREFERRED EMBODIMENTS

Figure 2:
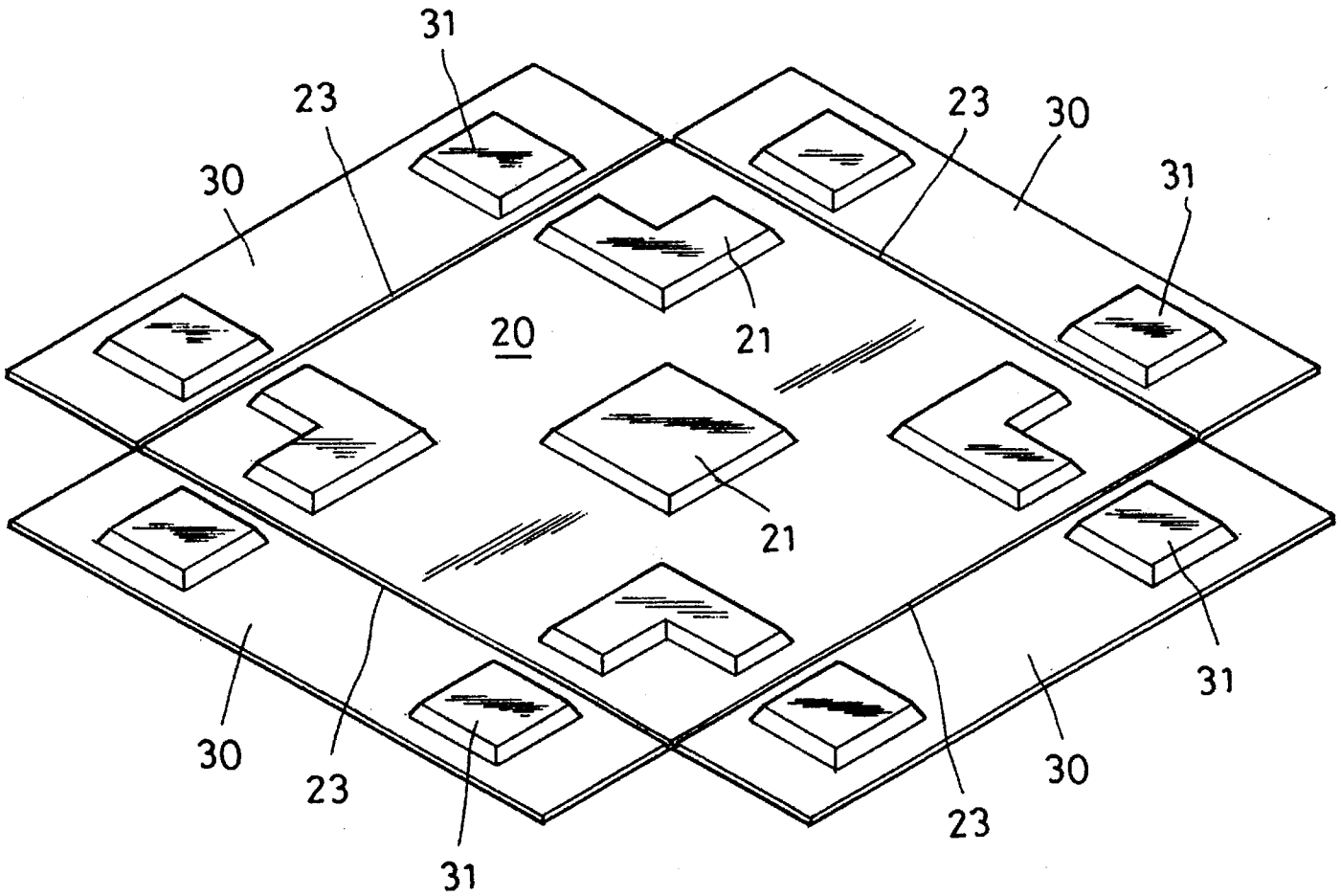
FIG. 2 is a perspective view of a first embodiment of the foldable pulp-molded cushioning material according to the present invention.
Figure 3:
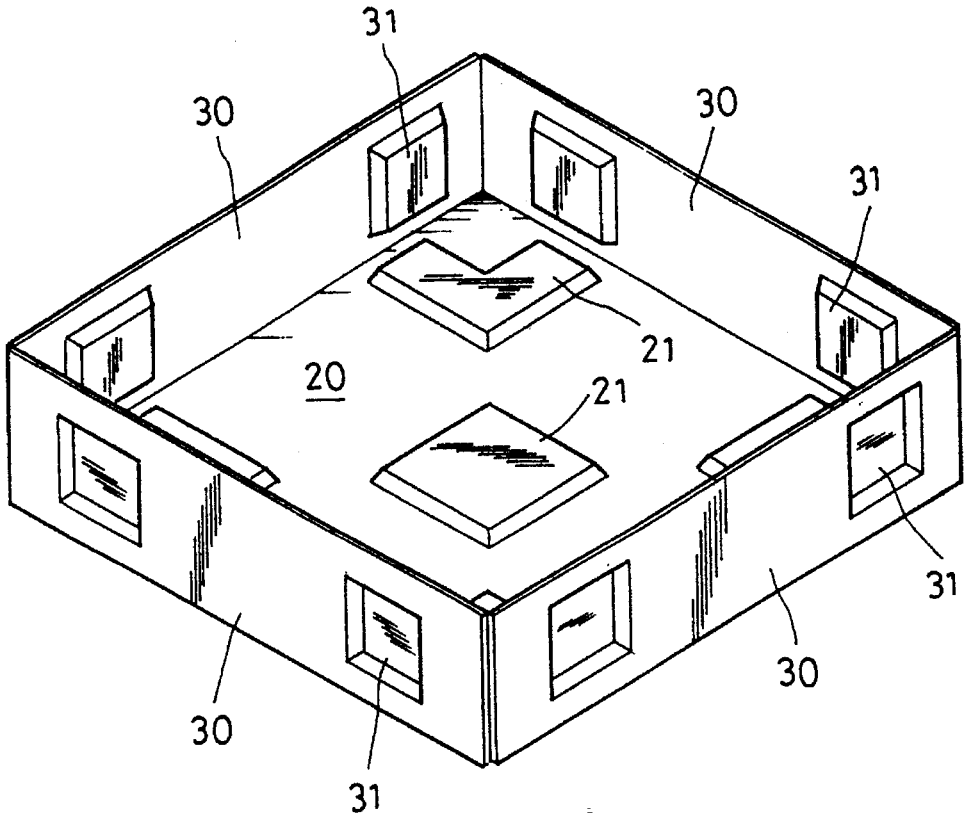
FIG. 3 is a perspective view of the cushioning material of FIG. 2 with the flaps thereof being erected relative the bottom along the notches.

Please refer to FIG. 2 in which a first embodiment of the present invention is shown. According to this first embodiment, the present invention is mainly a flat and unfolded pulp-molded cushioning material consisting of a rectangular bottom 20 disposed at a central portion of the cushioning material and four flaps 30 extending from four edges of the bottom 20 to a predetermined length. Raised portions 21, 31 are formed on the rectangular bottom 20 and the flaps 30, respectively, at adequate positions to serve as shock absorbers. Notches 23 are provided at joints of the bottom 20 and the flaps 30 so that the flaps 30 can be erected relative to the bottom 20 along their respective notch to form a box-like cushioning material, as shown in FIG. 3.

The flat and unfolded pulp-molded cushioning material as shown in FIG. 2 is in a form exactly the same as that when it is produced. This flat configuration allows the cushioning material of the present invention to be conveniently stored, transported, or carried by superposing one upon another. The flat cushioning material of the present invention can be neatly stacked just as stacking sheets of paper without occupying large room which is apparently an advantage in view of storage and transportation thereof.

Figure 4:
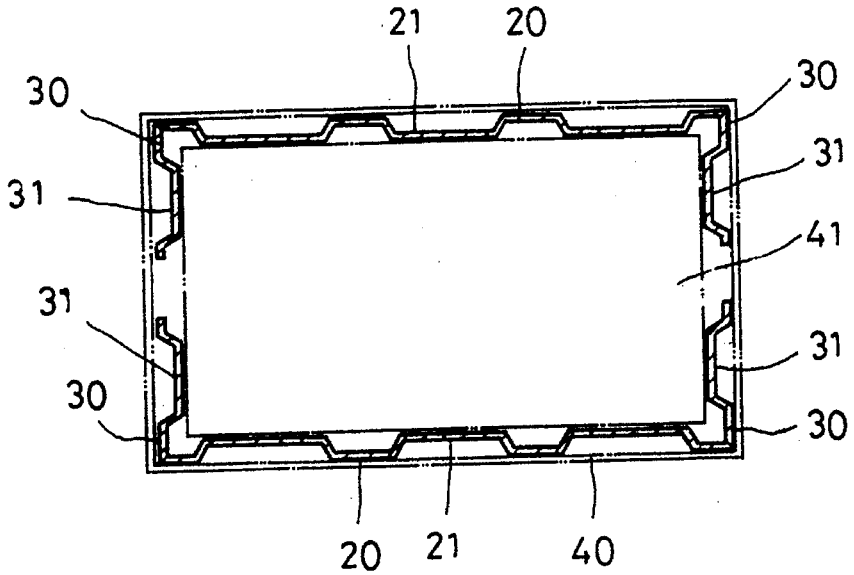
FIG. 4 is a top sectional view showing the first embodiment of the present invention with erected flaps being placed in a packing container to protect the product packed therein.

To use the foldable pulp-molded cushioning material of the present invention, first use it to wrap up a product 41 and then put the product 41 along with the cushioning material into a packing container 40. As shown in FIG. 4, the four upwardly erected flaps 30 are restricted in place by the side walls of the packing container 40 and thereby maintain their upright position, acting as a box-like cushioning material. Moreover, the raised portions 21, 31 of the flat cushioning material may be so formed and disposed to have a configuration and positions corresponding to the contour of the product 41 to be packed and protected, allowing the cushioning material to completely fitly contact with the packed product 41 at its inner sides and the side walls of the packing container at its outer sides. With this completely fit contact of the cushioning material with the packed product and the packing container, the cushioning material may provide better cushioning effect.

With the unfolded flat body, the cushioning material of the present invention does not require any flange around its periphery to prevent possible deformation of the cushioning material. That is, the foldable pulp-molded cushioning material of the present invention would not deform even though it is not provided with a peripheral flange. Instead, the non-flange side walls of the box-like cushioning material formed by erecting the flaps thereof allow the cushioning material to best fitly contact with the packed product 41 and with the side walls of the packing container.

Figure 5:
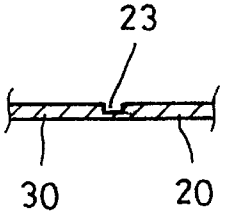
FIG. 5 is a fragmentary, enlarged view showing the notch of the present invention.
Figure 6:
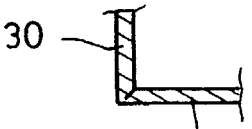
FIG. 6 is a fragmentary, enlarged view showing the flap being erected relative to the bottom along the notch.
Figure 8:
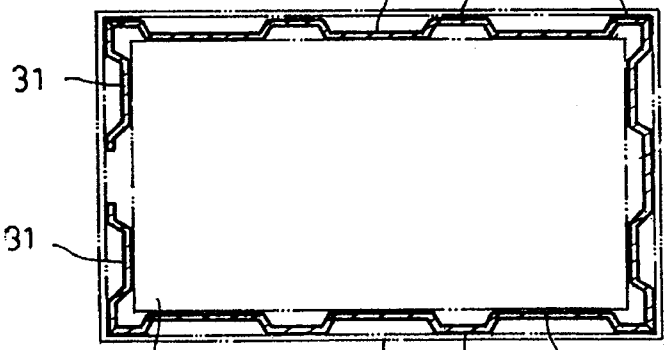
FIG. 8 is a top sectional view showing the second embodiment of the present invention with erected flaps being placed in a packing container to protect the product packed therein.
Figure 1:
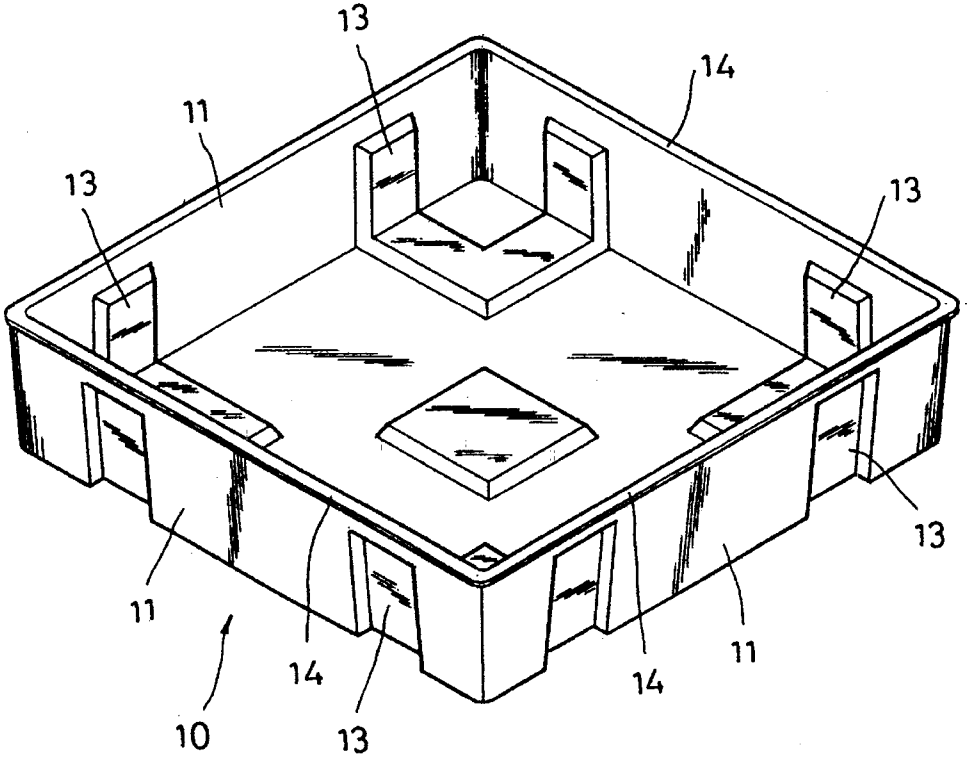
FIG. 1 is a perspective of a conventional three-dimensional cushioning material.
Figure 7:
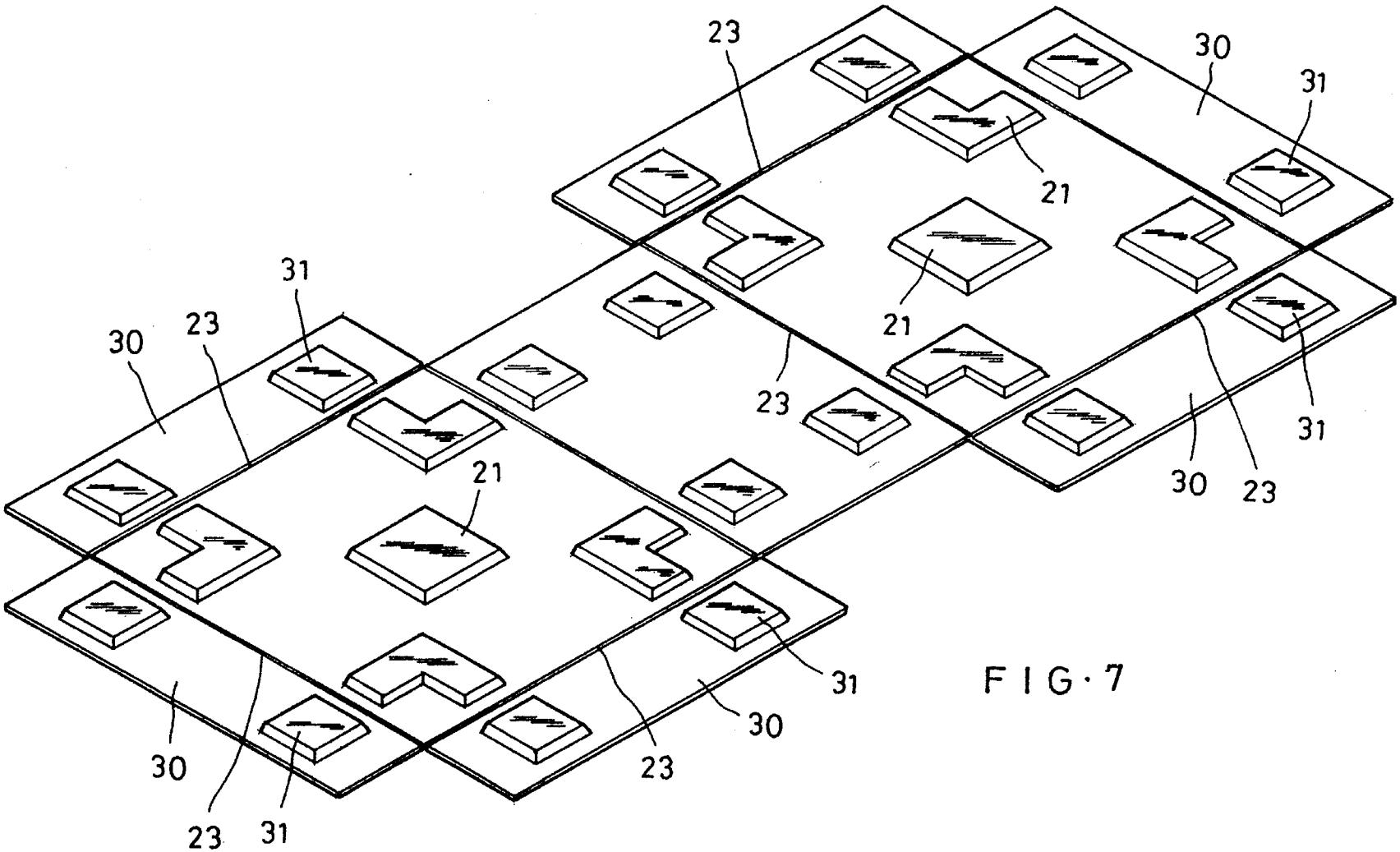
FIG. 7 is a perspective view of a second embodiment of the present invention.

The present invention may also be formed in various foldable patterns depending on the actual need. FIG. 7 illustrates another embodiment of the present invention. Not like the packaging shown in FIG. 4 in which two pieces of the first embodiment shown in FIG. 2 are separately used to wrap up the product 41 from a top side and a bottom side thereof to achieve the purpose of cushioning, the second embodiment is a one-piece foldable cushioning material but includes two integrally formed pieces of the foldable cushioning material shown in FIG. 2 and can be used to wrap up the whole product 41 in one step as shown in FIG. 8 to achieve the shock abosorbing purpose.

Since the present invention is in the form of foldable body, the mold for manufacturing it needs not to be very thick and therefore can be precisely engraved and drilled more easily than the conventional ones can while the manufacturing cost thereof can be lowered, too.

In the present invention, the employment of notches 23 to allow the cushioning material to be easily converted into a box-like cushioning material is a creative design which is not found in any of the prior designs. The conventional pulp-molded and other cushioning materials are always made to have the form of a three-dimensional box instead of a foldable body. That is, the flat but foldable pulp-molded cushioning material with properly raised portions according to the present invention may not only provide enhanced cushioning effect by fitly contact with the packed product and the outer packing container, but also reduce the costs in the mold manufacture, storage, and transportation thereof.

What is claimed is:

1. A foldable pulp-molded cushioning material comprising a flat body on which a plurality of raised portions are formed to serve as shock absorbers and a plurality of notches are provided so as to allow said flat body to be folded along said notches to form a three-dimensional box-like means to wrap therein an article to be packed, whereby said folded pulp-molded cushioning material causes said article to be cushioned and protected from potential collisions and impacts that impinge upon it.

2. A foldable pulp-molded cushioning material according to claim 1 wherein said raised portions are formed matching a contour or said article to be wrapped.

* * * * *